US008132747B2

(12) United States Patent
Donckers, II et al.

(10) Patent No.: US 8,132,747 B2
(45) **Date of Patent: *Mar. 13, 2012**

(54) METHOD OF MAKING HYDROPHILIC FLUOROPOLYMER MATERIAL

(75) Inventors: J. Michael Donckers, II, Decatur, AL (US); Arthur Russell Nelson, Decatur, AL (US); Chester Darryl Moon, Tuscumbia, AL (US)

(73) Assignee: Toray Fluorofibers (America), Inc., Decatur, AL (US)

( * ) Notice: Subject to any disclaimer, the term of this patent is extended or adjusted under 35 U.S.C. 154(b) by 350 days.

This patent is subject to a terminal disclaimer.

(21) Appl. No.: 12/396,808

(22) Filed: Mar. 3, 2009

(65) Prior Publication Data

US 2010/0224710 A1 Sep. 9, 2010

(51) Int. Cl.
*B02C 19/06* (2006.01)

(52) U.S. Cl. ..... 241/5; 241/23; 241/39

(58) Field of Classification Search ..... 241/5, 23, 241/39

See application file for complete search history.

(56) References Cited

U.S. PATENT DOCUMENTS

| | | | | |
|---|---|---|---|---|
| 2,772,444 | A | 12/1956 | Burrows et al. | |
| 2,919,862 | A | 1/1960 | Beike et al. | |
| 3,114,672 | A | 12/1963 | Schott | |
| 3,655,853 | A | 4/1972 | Gallup | |
| 3,771,729 | A | 11/1973 | Frable | |
| 4,198,004 | A | 4/1980 | Albus et al. | |
| 4,273,294 | A | 6/1981 | Hollely et al. | |
| 4,526,324 | A | 7/1985 | Stephanoff et al. | |
| 5,229,460 | A * | 7/1993 | Yousuf et al. | 525/198 |
| 5,723,081 | A | 3/1998 | Blankenbeckler et al. | |
| 5,762,846 | A | 6/1998 | Blankenbeckler et al. | |
| 5,820,984 | A | 10/1998 | Blankenbeckler et al. | |
| 6,196,482 | B1 | 3/2001 | Goto | |
| 7,258,290 | B2 | 8/2007 | Taketomi et al. | |
| 7,346,961 | B2 | 3/2008 | Miwa et al. | |
| 2005/0100733 | A1 | 5/2005 | Foss et al. | |
| 2006/0246343 | A1 * | 11/2006 | Mitchell et al. | 429/44 |
| 2008/0033132 | A1 * | 2/2008 | Schlipf et al. | 526/255 |
| 2009/0050718 | A1 * | 2/2009 | Henry et al. | 241/5 |
| 2010/0224710 | A1 | 9/2010 | Donckers et al. | |
| 2010/0224712 | A1 | 9/2010 | Donckers et al. | |

* cited by examiner

*Primary Examiner* — Bena Miller
(74) *Attorney, Agent, or Firm* — C. Brandon Browning; Maynard Cooper + Gale, PC

(57) ABSTRACT

A fluoropolymer material exhibiting an increased hydrophilicity prepared by processing the material in a jet mill.

37 Claims, 20 Drawing Sheets

METHOD OF MAKING HYDROPHILIC FLUOROPOLYMER MATERIAL

FIELD OF INVENTION

The present invention relates to a method for preparing a hydrophilic fluoropolymer material. More particularly, the present invention relates to a method of increasing the hydrophilicity of polytetrafluoroethylene flock or staple by jet mill processing the flock or staple.

BACKGROUND OF INVENTION

Fluoropolymers have properties such as extremely low coefficient of friction, wear and chemical resistance, dielectric strength, temperature resistance and various combinations of these properties that make fluoropolymers useful in numerous and diverse industries. For example, in the chemical process industry, fluoropolymers are used for lining vessels and piping. The biomedical industry has found fluoropolymers to be biocompatible and so have used them in the human body in the form of both implantable parts and devices with which to perform diagnostic and therapeutic procedures. In other applications, fluoropolymers have replaced asbestos and other high temperature materials. Wire jacketing is one such example. Automotive and aircraft bearings, seals, push-pull cables, belts and fuel lines, among other components, are now commonly made with a virgin or filled fluoropolymer component.

In order to take advantage of the properties of fluoropolymers, fluoropolymers often must be modified by decreasing their lubricity in order to be bonded to another material. That is because the chemical composition and resulting surface chemistry of fluoropolymers render them hydrophobic and therefore notoriously difficult to wet. Hydrophobic materials have little or no tendency to adsorb water and water tends to "bead" on their surfaces in discrete droplets. Hydrophobic materials possess low surface tension values and lack active groups in their surface chemistry for formation of "hydrogen-bonds" with water. In the natural state, fluoropolymers exhibit these hydrophobic characteristics, which requires surface modification to render it hydrophilic. The applications mentioned above all require the fluoropolymer to be modified.

One such modification includes chemically etching the fluoropolymers. For example, fluoropolymer films and sheets are often etched on one side to enable bonding it to the inside of steel tanks and piping; the outside diameter of small diameter, thin wall fluoropolymer tubing is etched to bond to an over-extrusion resulting in a fluoropolymer-lined guide catheter for medical use; fluoropolymer jacketed high-temperature wire is etched to allow the printing of a color stripe or other legend such as the gauge of the wire and/or the name of the manufacturer; fluoropolymer based printed circuit boards require etching to permit the metallization of throughholes creating conductive vertical paths between both sides of a double sided circuit board or connecting several circuits in a multilayer configuration.

The first commercially viable processes were chemical in nature and involved the reaction between sodium and the fluorine of the polymer. In time, some of the chemistry was changed to make the process less potentially explosive and hazardous, but the essential ingredient—sodium—remains the most reliable, readily available chemical 'abrasive' for members of the fluoropolymer family.

In addition to being hazardous, chemically etched fluoropolymer surfaces tend to lose bond strength over time. It has been shown that temperature, humidity and UV light have a detrimental effect on etched surfaces. Tests have shown that etched fluoropolymer parts exposed to 250° F. for 14 days exhibit bond strengths approximately 40% weaker than those done on the day they were etched. Further, depending upon the wavelength and intensity of the UV light source, the bond strength deterioration can occur over a period of months and years. It is thought that, due to the somewhat amorphous nature of these polymers, a rotational migration occurs over time, accelerated by some ambient conditions—especially heat—that re-exposes more of the original C2F4 molecule at the surface resulting in a lower coefficient of friction.

Another factor that is of concern with chemical etching of fluoropolymers is that of the depth of the etched layer. The sodium reaction with fluorine is a self-limiting one, and it has been shown to take place to a depth of only a few hundred to a few thousand Angstroms.

SUMMARY OF THE INVENTION

The present invention is directed to a fluoropolymer material exhibiting increased hydrophilicity. The increased hydrophilicity is provided by modifying or deforming the physical appearance of the material. The modifications are created by forming tears in the material. These tears appear as slits formed within the body of the material, splits through the ends of the material and combinations thereof.

The tears are formed by mechanically processing the material. One process includes placing a fluoropolymer material into an air stream and introducing mechanical energy into the material by colliding the material against itself. Another process includes cooling the fluoropolymer material, making the material brittle and then mechanically grinding it. It is believed that in most instances the tears are formed between the individual fluoropolymer particles that make up the material.

The surface modifications brought about by these processes increase the surface area and roughness of the fluoropolymer materials. As a result, the lubricity of the material is decreased and the hydrophilicity is increased. This allows the fluoropolymer material to form long-lasting, homogenous slurries in aqueous solutions. It is believed that these modifications will allow the materials to be more easily mixed with resins and thermoplastics and molded into parts.

Other features of the present invention will become apparent from a reading of the following description, as well as a study of the appended drawings.

DETAILED DESCRIPTION OF THE INVENTION

Figure 1:
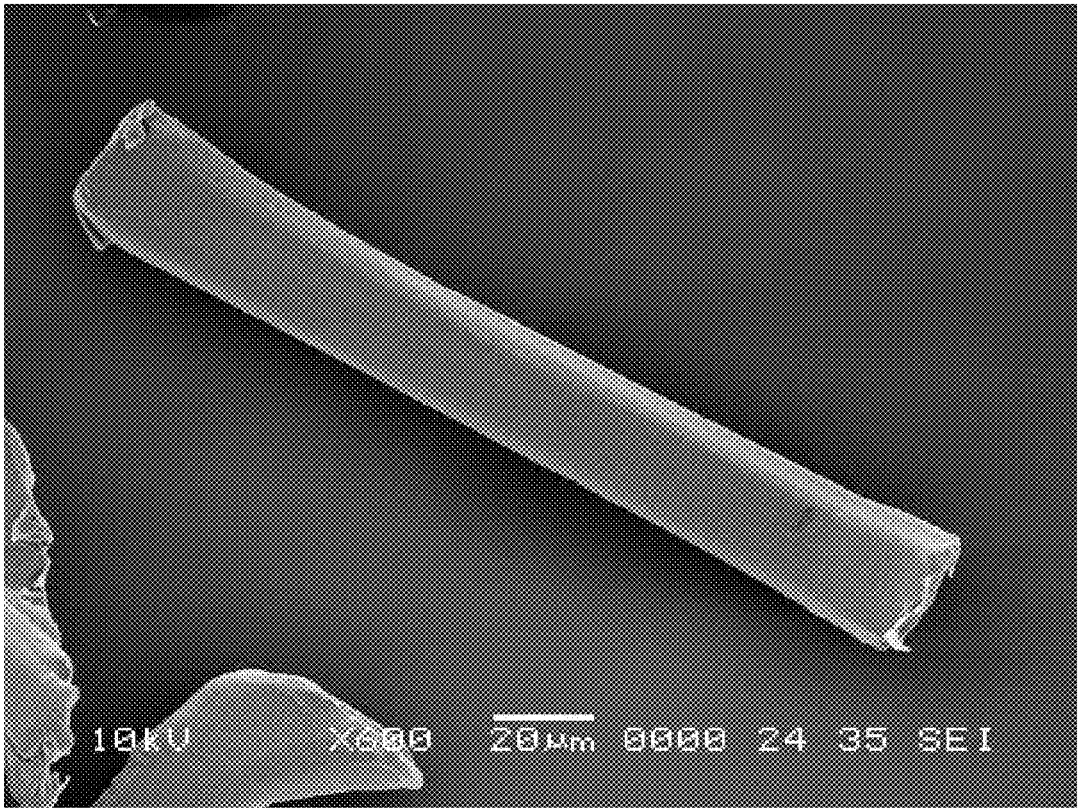
FIG. 1 is a scanning electron micrograph ("SEM") of a virgin PTFE floe material, as prepared in Example 1.
Figure 2:
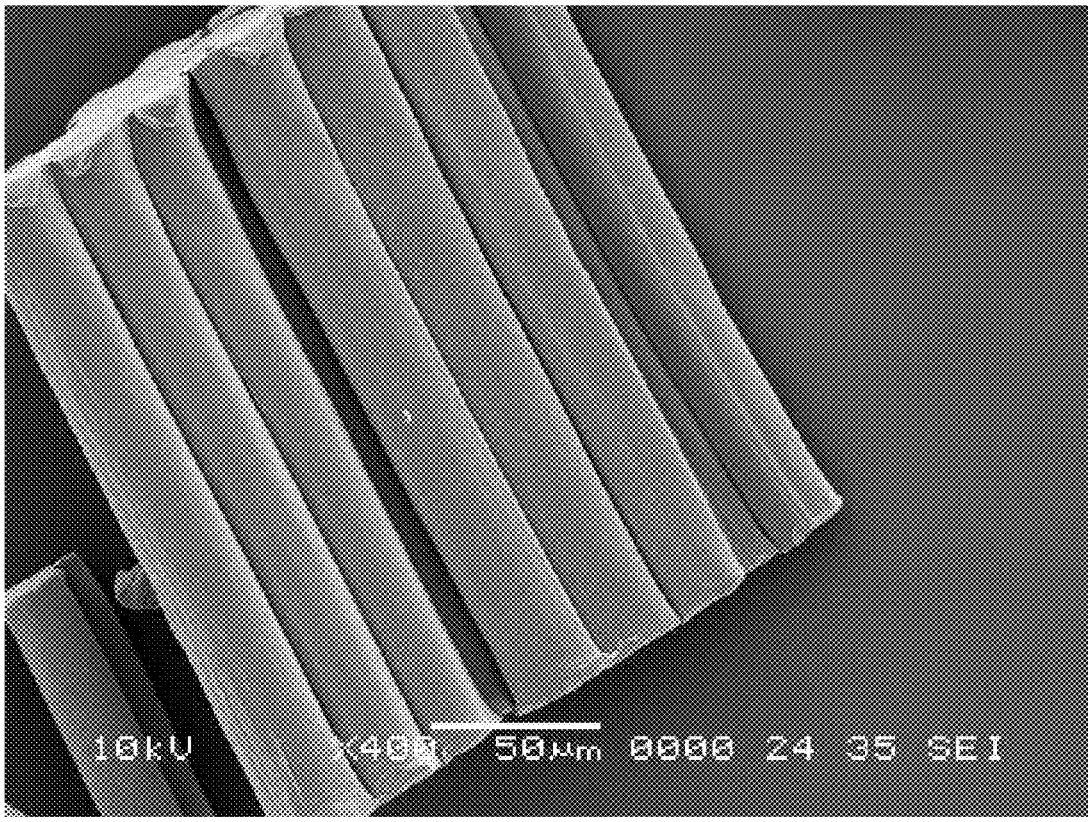
FIG. 2 is a SEM of virgin PTFE floe material, as prepared in Example 1.
Figure 3:
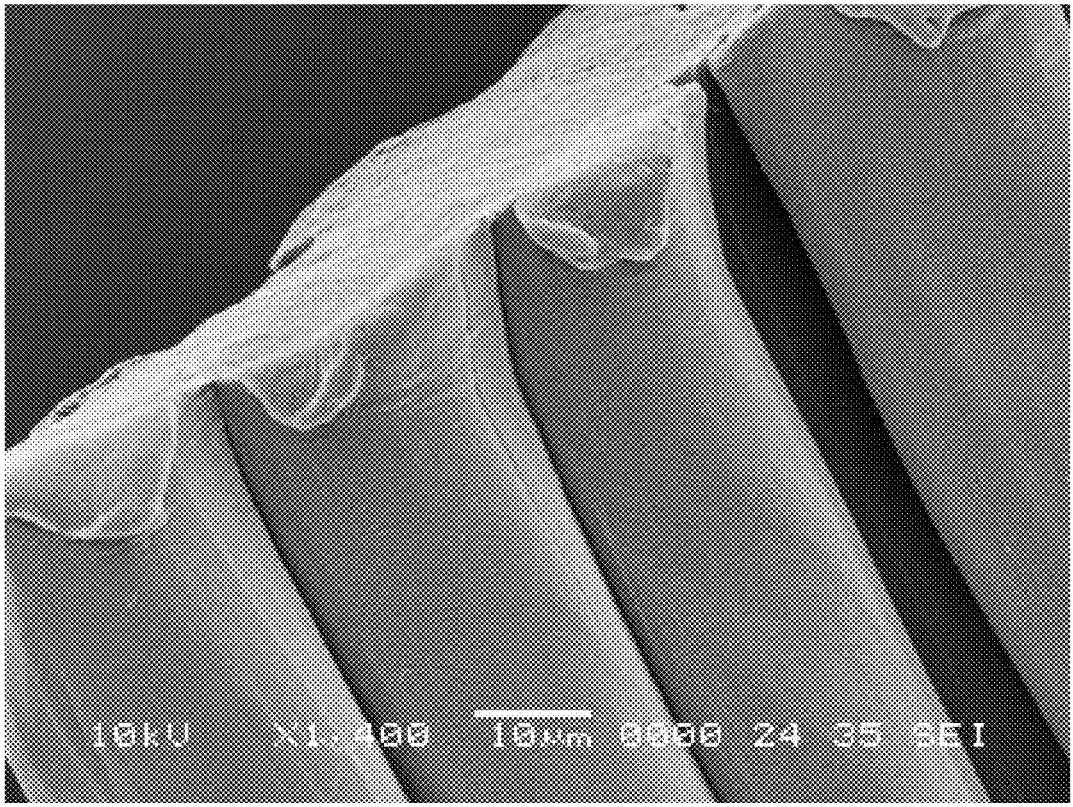
FIG. 3 is a SEM of a virgin PTFE floe material, as prepared in Example 1.

The fluoropolymer material of the present invention is preferably prepared from a fluoropolymer fiber, such as continuous fluoropolymer filament yarn, which is made into floc or staple and processed in jet mil or a cryogenic grinder. In each process, the physical appearance of the fluoropolymer fibers is modified in a manner that improves the hydrophilicity of the material. This occurs by forming deformations in the fluoropolymer fibers that are visible using scanning electron microscopy at magnifications as low as X120. The deformations act to increase and roughen the surface area of the fibers by tearing the typically smooth exterior body and ends of the individual floc fibers and providing the fibers with split ends, slits along the bodies of the fibers, outwardly extending, fibril-like members, and exposed interior fiber portions.

In the present invention, by "fluoropolymer fiber" it is meant a fiber prepared from polymers such as polytetrafluoroethylene ("PTFE"), and polymers generally known as fluorinated olefinic polymers, for example, copolymers of tetrafluoroethylene and hexafluoropropene, copolymers of tetrafluoroethylene and perfluoroalkyl-vinyl esters such as perfluoropropyl-vinyl ether and perfluoroethyl-vinyl ether, fluorinated olefinic terpolymers including those of the above-listed monomers and other tetrafluoroethylene based copolymers. For the purposes of this invention, the preferred fluoropolymer fiber is PTFE fiber.

In the present invention, by "split" it is meant a tear that extends along a length of a fluoropolymer material and out through an end of the fiber. A spilt can appear as a crack through an end of the fiber or result in the formation of separated or partially separated fiber strands, each strand having a free end and an attached end. In some instances, the end of a fiber may include a single split thereby giving rise to a pair of strands, which may or may not have the same thickness. Alternatively, the end of a fiber may include many splits thereby giving rise to many strands. In this instance, the end of the fiber can have a frayed appearance depending on the number and lengths of the splits. A split typically does not result in the removal of material or a substantial amount of material from the fiber. However, in some instances, a split can extend along a length of a fiber and result in the complete removal of a sliver-like portion of the fiber, or along the entire length of the fiber thus removing a side of the fiber.

In the present invention, by "slit" it is meant a tear that extends partially along a length of a fluoropolymer fiber but does not extend through one of the opposing ends of the fiber. Slits often appear as an elongated, continuous openings that extend into an interior of the fiber to a particular depth. Like a split, a slit typically does not result in the removal of material or a substantial amount of material from the fiber.

In the present invention, by "grain" it is meant a longitudinal arrangement or pattern of fibril-like members. Often, a tear in the fluoropolymer fiber will expose an interior surface of the fiber. These interior surfaces can exhibit a grain running longitudinally along the axis of the fiber. The grain gives the exposed interior surface of the fiber the appearance of ridges extending lengthwise along the exposed interior surface.

In the present invention, by "fibril-like members" it is meant the elongated pieces that make up the grain of a fluoropolymer fiber. Under the various magnifications exhibited in the figures, the fibril-like members are not visible along a length of the exterior surface of the fibers. However, they are visible on the interior surfaces of the fluoropolymer fibers when the interior surfaces are exposed, for example, by a tear. When the fluoropolymer fiber is torn, exposing the interior surfaces of the fibers, a portion of the fibril-like members appear to become partially dislodged from the fibers and extend outwardly therefrom. These fibril-like members have attached ends and free ends which extend outwardly from exposed interior surfaces of the fluoropolymer fiber.

The fluoropolymer fiber of the present invention can be spun by a variety of means, depending on the exact fluoropolymer composition desired. Thus, the fibers can be spun by dispersion spinning; that is, a dispersion of insoluble fluoropolymer particles is mixed with a solution of a soluble matrix polymer and this mixture is then coagulated into filaments by extruding the mixture into a coagulation solution in which the matrix polymer becomes insoluble. The insoluble matrix material may later be sintered and removed by oxidative processes if desired. One method which is commonly used to spin PTFE and related polymers includes spinning the polymer from a mixture of an aqueous dispersion of the polymer particles and viscose, where cellulose xanthate is the soluble form of the matrix polymer, as taught for example in U.S. Pat. Nos. 3,655,853; 3,114,672 and 2,772,444. However, the use of viscose suffers from some serious disadvantages. For example, when the fluoropolymer particle and viscose mixture is extruded into a coagulation solution for making the matrix polymer insoluble, the acidic coagulation solution converts the xanthate into unstable xantheic acid groups, which spontaneously lose CS2, an extremely toxic and volatile compound. Preferably, the fluoropolymer fiber of the present invention is prepared using a more environmentally friendly method than those methods utilizing viscose. One such method is described in U.S. Pat. Nos. 5,820,984; 5,762,846, and 5,723,081, which patents are incorporated herein in their entireties by reference. In general, this method employs a cellulosic ether polymer such as methylcellulose, hydroxyethylcellulose, methylhydroxypropylcellulose, hydroxypropylmethylcellulose, hydroxypropylcellulose, ethylcellulose or carboxymethylcellulose as the soluble matrix polymer, in place of viscose. Alternatively, if melt viscosities are amenable, filament may also be spun directly from a melt. Fibers may also be produced by mixing fine powdered fluoropolymer with an extrusion aid, forming this mixture into a billet and extruding the mixture through a die to produce fibers which may have either expanded or un-expanded structures. For the purposes of this invention, the preferred method of making the fluoropolymer fiber is by dispersion spinning where the matrix polymer is a cellulosic ether polymer.

The fluoropolymer fiber can be made into floc or staple using any number of means known in the art. Preferably, the fluoropolymer fiber is cut into floe or staple by a guillotine cutter, which is characterized by a to-and-fro movement of a cutting blade. Following cutting, the fluoropolymer fibers preferably have lengths ranging between 127 microns and 115,000 microns.

The process for modifying the physical appearance of the fluoropolymer materials by forming deformations in the fibers is achieved by introducing mechanical energy into the fluoropolymer fibers to such a degree that the ends of the fibers are split, slits are formed in the bodies of the fibers, a grain of the fiber is exposed, and fibril-like members are extended outwardly from exposed interior surface portions of the fibers. Preferably, the processes do not substantially decrease the length of the individual fibers.

One suitable process includes entraining the fibers in an air stream, directing the entrained fibers through an orifice and colliding the pieces into one another. This process is preferably carried out using a jet mill and jet milling processes, examples of which are described in U.S. Pat. Nos. 7,258,290; 6,196,482, 4,526,324; and 4,198,004. Another suitable process includes cooling the fluoropolymer fibers to a cryogenic temperature of about −268° C. or less, depending on the low temperature embrittlement properties of the particular fibers, and then grinding the fibers. This process is preferably carried out using a cryogrinder and cryogrinding processes, examples of which are described in U.S. Pat. Nos. 4,273,294; 3,771,729; and 2,919,862.

Jet mills and cryogrinders are conventionally used to pulverize materials into fine particles or powder. For example, jet milling is a process that uses high pressure air to micronize friable, heat-sensitive materials into ultra-fine powders. Powder sizes vary depending on the material and application, but typically ranges from 75 to as fine as 1 micron can be prepared. Often materials are jet milled when they need to be finer than 45 microns. Cryogenic grinding is a process that uses liquid nitrogen to freeze the materials being size-reduced and one of a variety of grinding mechanisms to ground them to a powder distribution depending on the application. Particle sizes of 0.1 micron can be obtained. However, it has unexpectedly been found that jet or cryogenic milling can be carried out on the fluoropolymers materials of the present invention without the materials being pulverized or size-reduced. More particularly, it has been found that the materials can be processed with a jet mill or a cryogenic grinding mill without substantially affecting the lengths of fibers, while at the same time forming splits in the ends of the fibers, forming slits in the bodies of the fibers, forming outwardly extending, fibril-like members and exposing the interior surfaces of the materials. Also, unexpectedly, these modifications have been found to render the processed fluoropolymer materials hydrophilic thus converting a hydrophobic material into a hydrophilic material, or in the alternative, increasing or improving the hydrophilicity of the materials.

PREFERRED EMBODIMENTS OF THE INVENTION

The present invention will be explained further in detail by the following Examples. In each of the Examples, a 6.7 denier per filament continuous, cellulosic ether-based PTFE filament yarn was prepared and cut with a guillotine cutter into virgin floc.

Example 1

Figure 4:
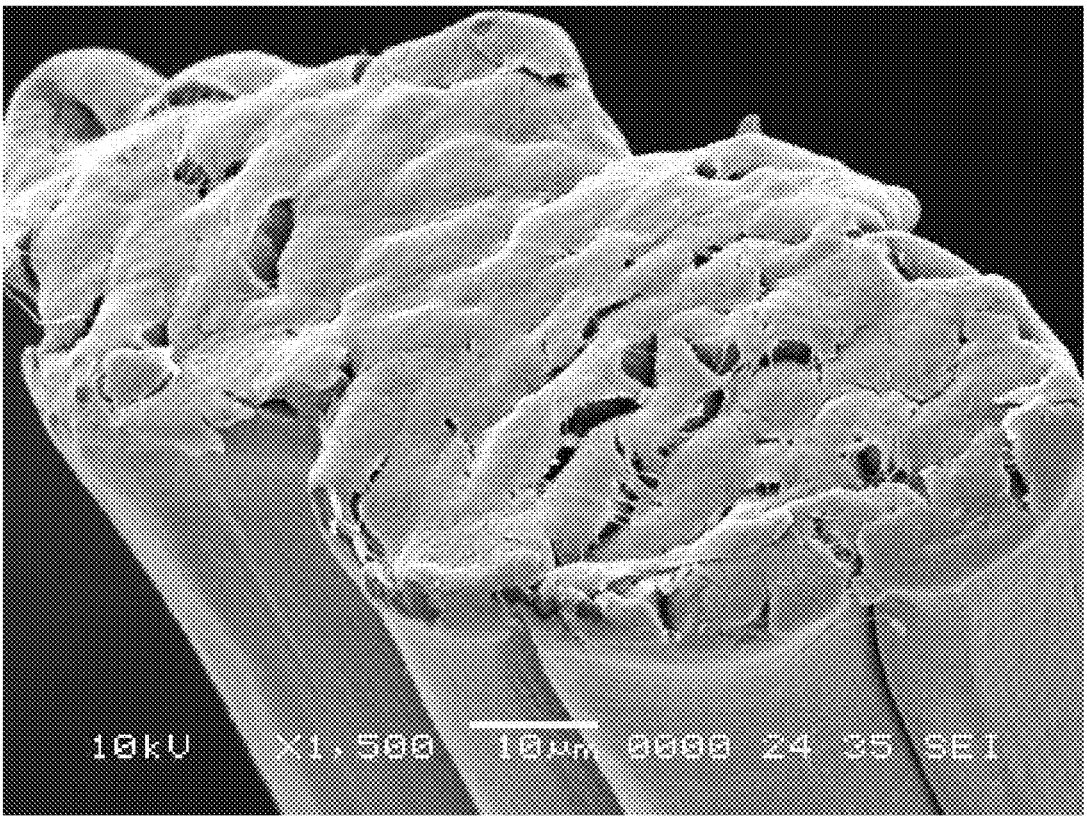
FIG. 4 is a SEM of a virgin PTFE floe material, as prepared in Example 1.

In Example 1, the virgin floe was cut into lengths of approximately 200 to 250 microns. As displayed in FIGS. 1 through 4, the virgin floe fibers had smooth, nearly featureless exterior surfaces along the lengths thereof. The ends of the floc fibers were substantially smooth and nearly featureless as well, with the exception of the PTFE floc fibers shown in FIG. 4, which exhibited some uneven areas which are believed to have resulted from the cutting process.

The wettability of the 200 to 250 microns virgin PTFE fiber floe was tested. In a first test, 50 grams of the floc and 200 ml of deionized water were placed into a Waring blender and mixed for 30 seconds. Thereafter, the mixture was observed. Immediately, the PTFE floc fibers that were not adhered to the walls of the blender or floating on top of the water began to settle to the bottom of the blender. This resulted in the formation of three distinct mixture portions including a floc rich bottom portion, a water rich middle portion and a top portion composed of PTFE fiber floc floating on top of the middle portion. The floc in the top portion appeared dry.

In a second test, the wettability of the PTFE fiber floc was determined by placing 50 grams of the floc and 200 ml of deionized water into a Waring blender, mixing the water and fibers for 30 seconds and immediately thereafter siphoning a portion of the mixture into a syringe. As in the first test, the PTFE floc fibers quickly settled into three portions including a floc rich bottom portion, a water rich middle portion and a top portion composed of floc fibers floating on top of the middle portion.

The results evidenced that the 200 to 250 microns virgin PTFE fiber floc was hydrophobic.

Example 2

Figure 5:
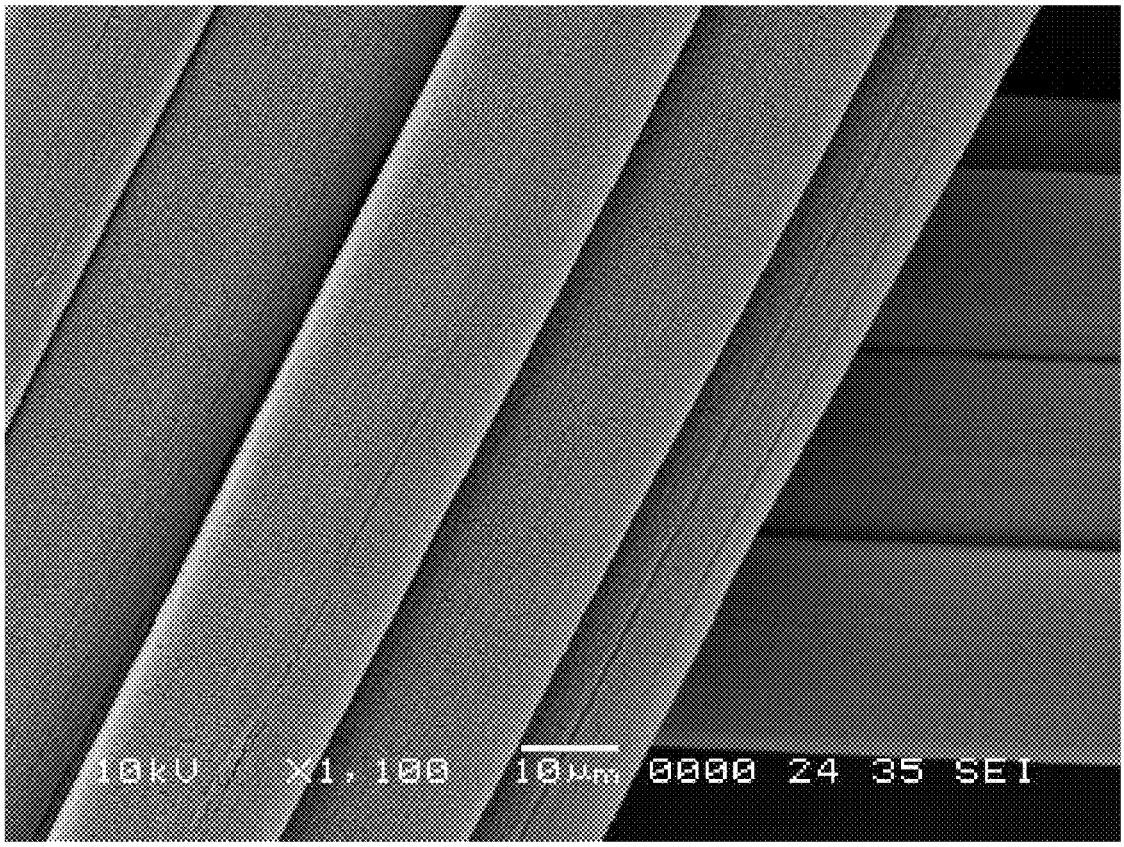
FIG. 5 is a SEM of a virgin PTFE floe material, as prepared in Example 2.

In Example 2, the virgin floc was cut into lengths of approximately 6350 microns. As displayed in FIG. 5, the virgin floc fibers had smooth, nearly featureless exterior surfaces along the lengths thereof. These figures further show that floc fibers tended to clump together.

The wettability of the 6350 microns virgin PTFE fiber floc was tested. Fifty grams of the floc and 200 ml of deionized water were placed into a Waring blender and mixed for 30 seconds. Thereafter, the mixture was observed. Immediately, the PTFE floc fibers began to settle to the bottom of the container. This resulted in the formation of two distinct mixture portions including a floc rich bottom portion and a water rich top portion The test results evidenced that the 6350 microns PTFE fiber floc was hydrophobic.

Example 3

In Example 3, a portion of the 200 to 250 microns virgin PTFE fiber floc was processed by jet milling and examined.

As shown in FIGS. 6 through 14, jet mill processing of the fluoropolymer fiber floc modified the physical appearance of the fluoropolymer fibers. The modifications included surface deformations caused by tearing of the fibers. The tearing resulted in the formation of split fiber ends, slits along the bodies of the fibers, and formation of outwardly extending, fibril-like members and the exposure of interior surfaces of the fibers. The exposed interior surfaces of the fibers exhibited a grain that in certain instances, where a split resulted in the removal of an entire side of the fiber, extended the entire length of the fibers. The grain appeared to be formed by the fibril-like members.

The majority of the fibril-like members remained fully coupled to the fiber surfaces after tearing thus providing the exposed interior surfaces with a number of longitudinally extending ridges. The ridges gave the exposed interior surfaces a rough appearance in contrast to the smooth exterior surfaces of the fibers. In other instances, the fibril-like members became partially detached from the fibers and extended outwardly from the fiber surfaces. These fiber surfaces primarily included the exposed interior surfaces but also included areas along the edges formed between the exterior surfaces and exposed interior surfaces of the fibers. An example of an exposed interior surface is well depicted in FIGS. 6, 7 and 12. It is believed that the fibril-like members constitute individual or small groupings of elongated or drawn PTFE particles. The partially detached fibril-like members were often bent or curved and had lengths in excess of 100 microns.

The slits appeared to form between groupings of the fibril-like members and individual fibril-like members. The observed members had lengths that were less than 20 microns and as long as 80 microns. The depth of the of the slits was difficult to determine, but it was found that some of the slits extended through the entire thickness or width of the PTFE fibers. A plurality of slits formed within a single fiber are well depicted in FIG. 8.

Figure 6:
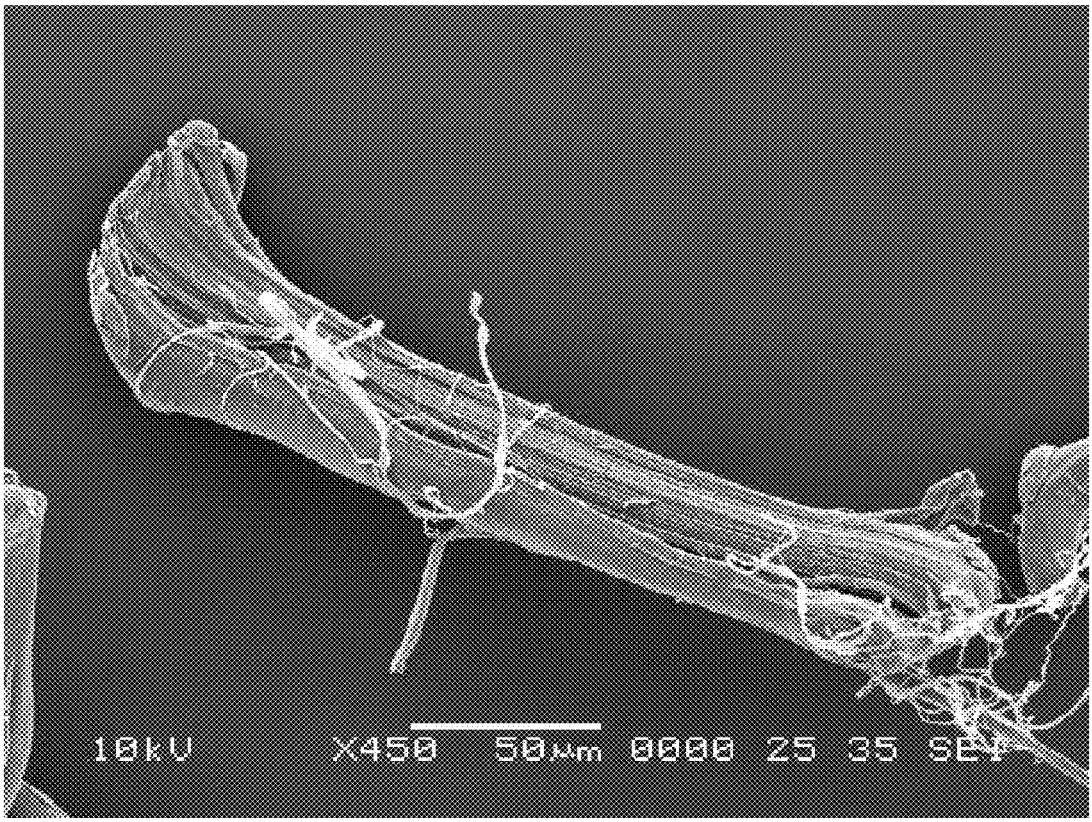
FIG. 6 is a SEM of a PTFE floe material according to the presently preferred embodiment of the present invention, as prepared in Example 3.
Figure 7:
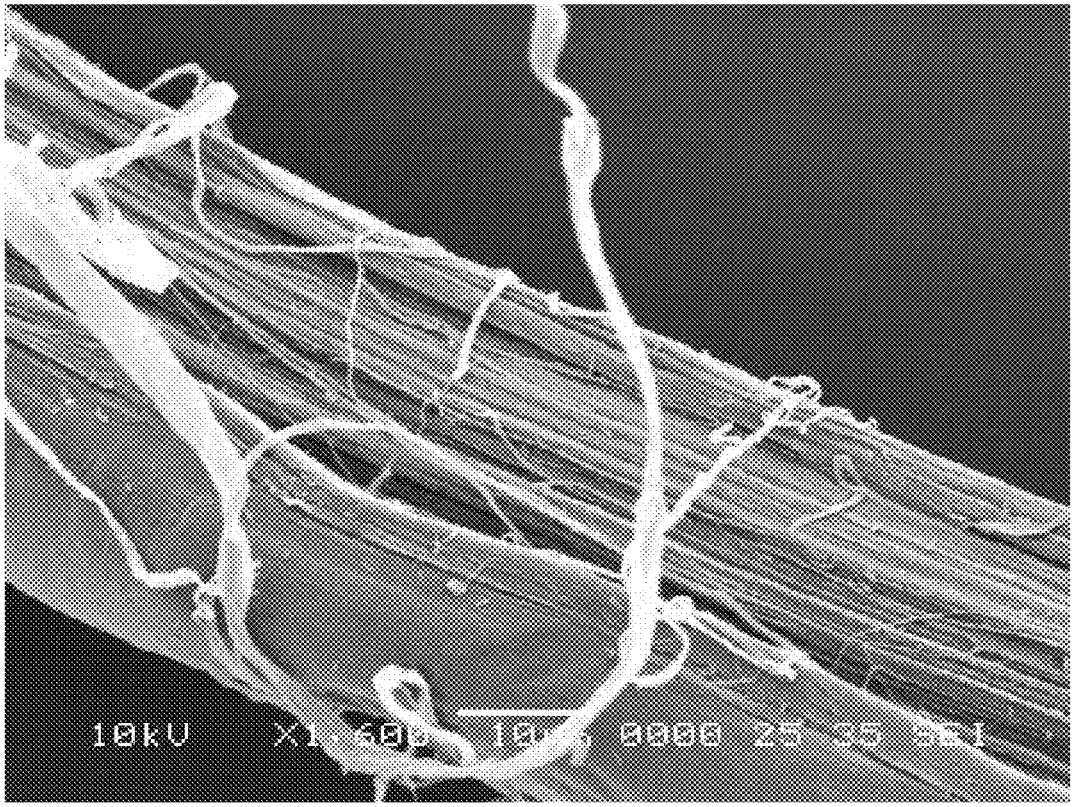
FIG. 7 is a SEM of a PTFE floe material according to the presently preferred embodiment of the present invention, as prepared in Example 3.
Figure 8:
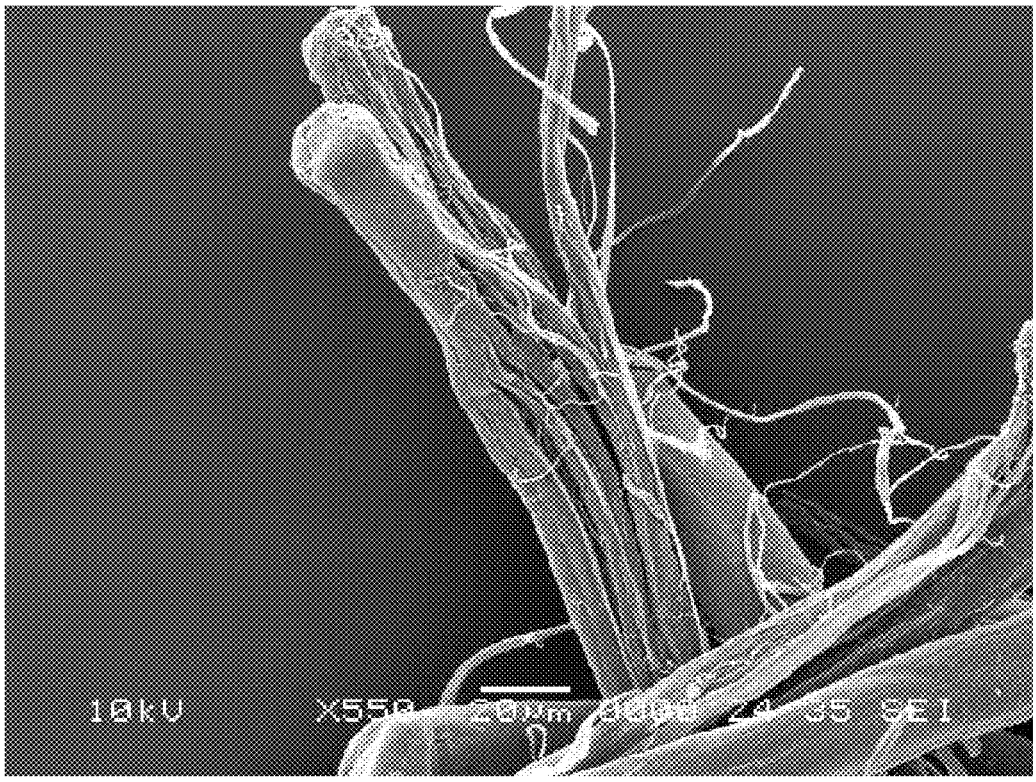
FIG. 8 is a SEM of a PTFE floe material according to the presently preferred embodiment of the present invention, as prepared in Example 3.
Figure 9:
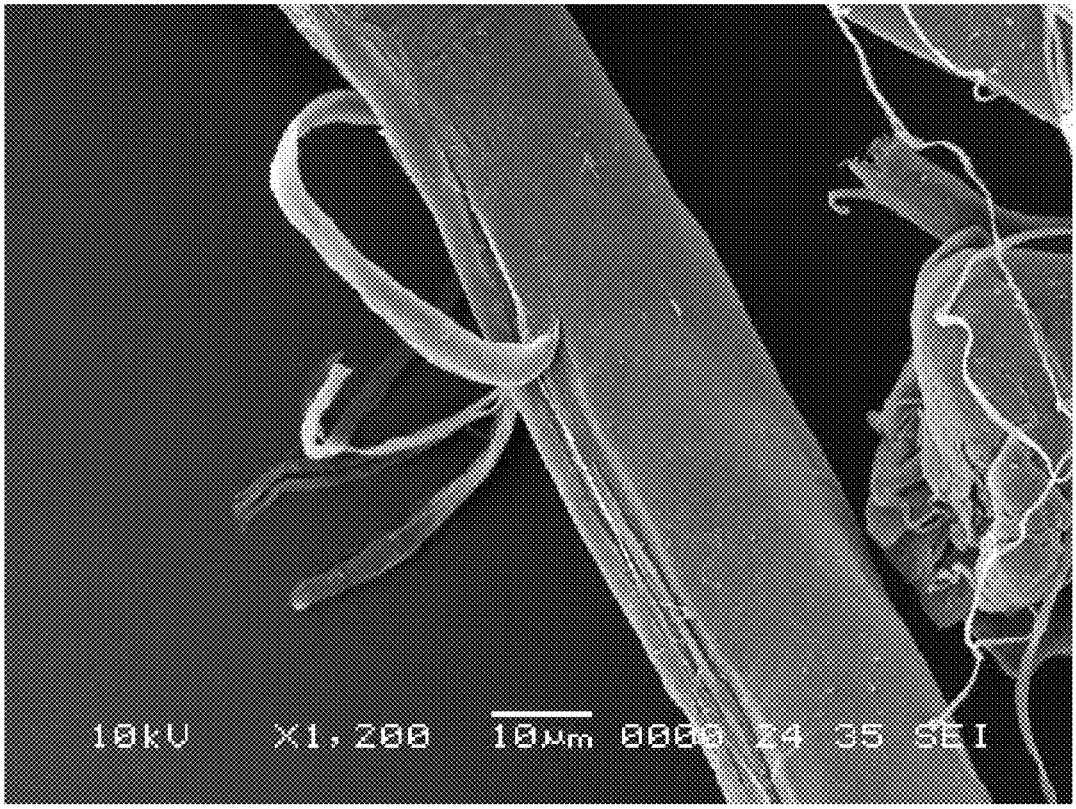
FIG. 9 is a SEM of a PTFE floe material according to the presently preferred embodiment of the present invention, as prepared in Example 3.
Figure 10:
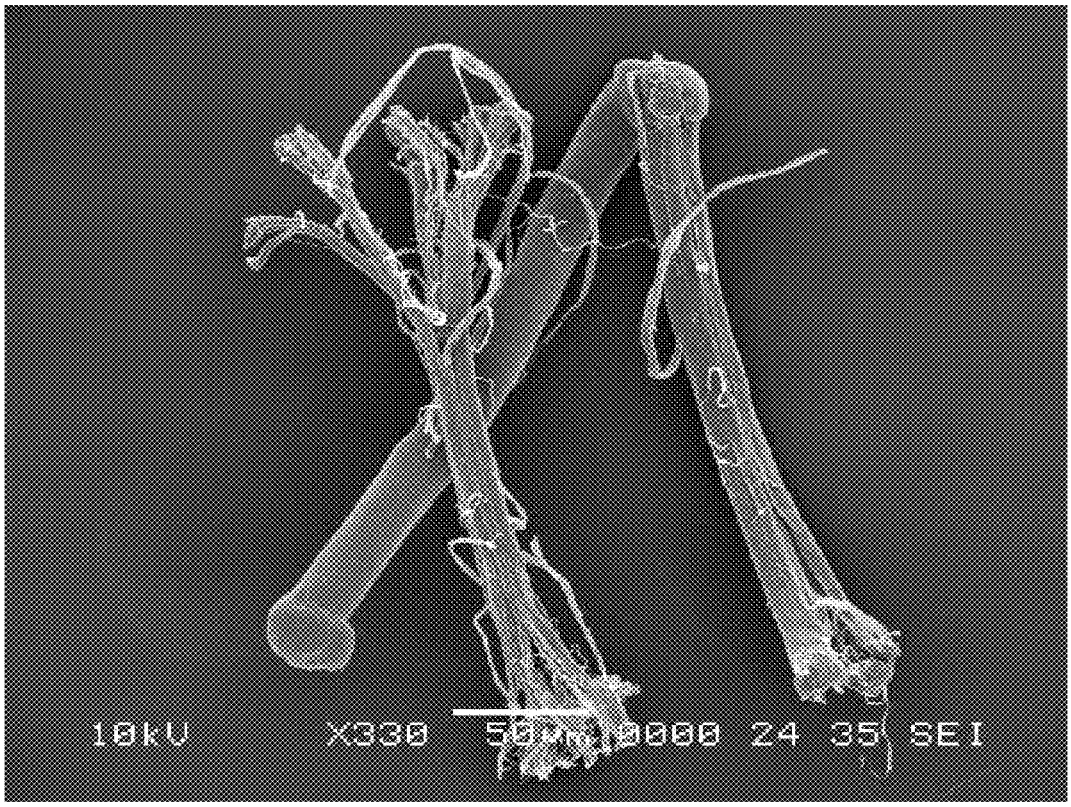
FIG. 10 is a SEM of a PTFE floe material according to the presently preferred embodiment of the present invention, as prepared in Example 3.
Figure 11:
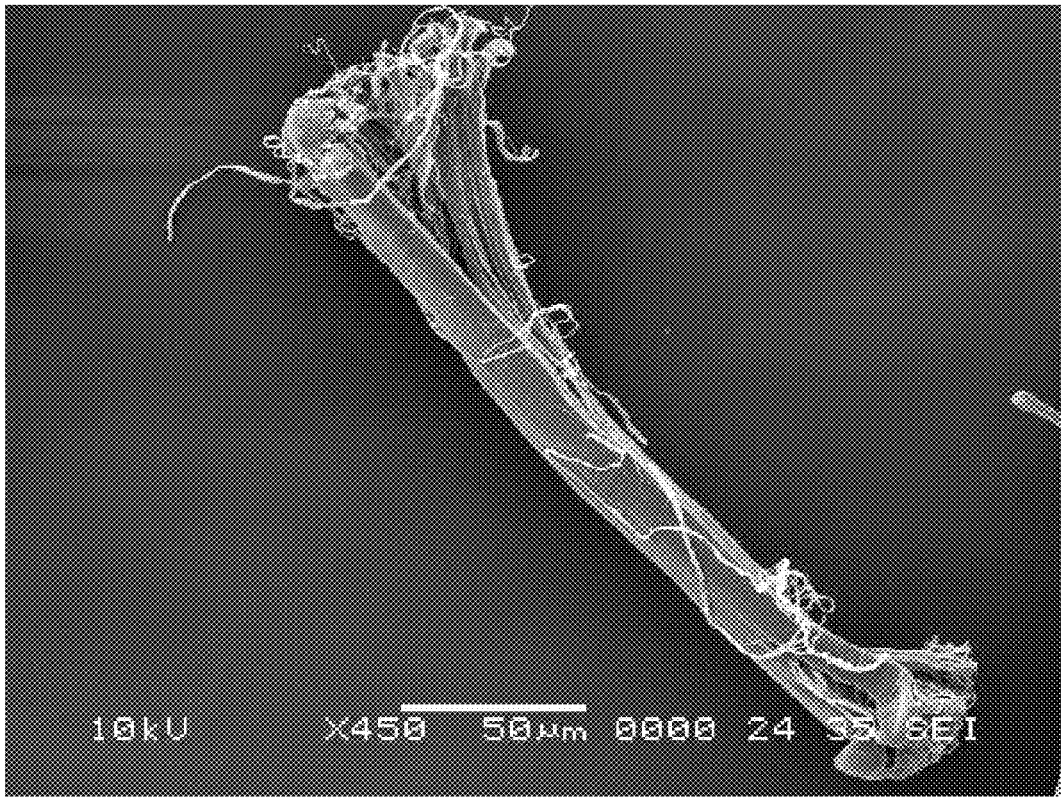
FIG. 11 is a SEM of a PTFE floe material according to the presently preferred embodiment of the present invention, as prepared in Example 3.
Figure 12:
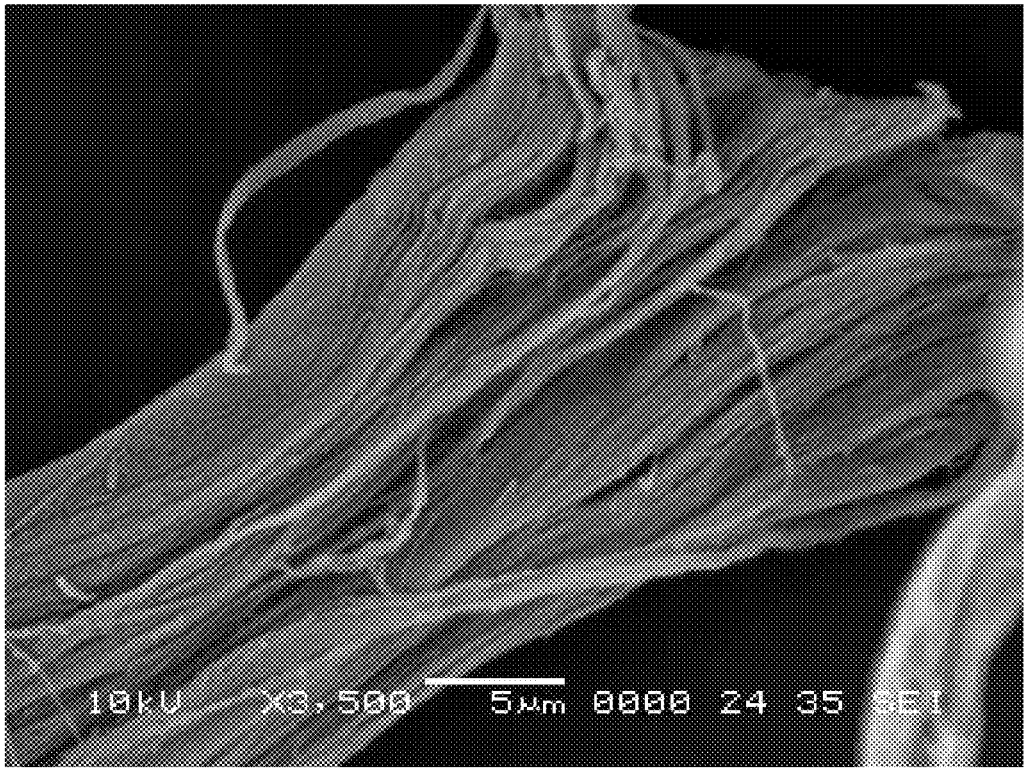
FIG. 12 is a SEM of a PTFE floe material according to the presently preferred embodiment of the present invention, as prepared in Example 3.
Figure 13:
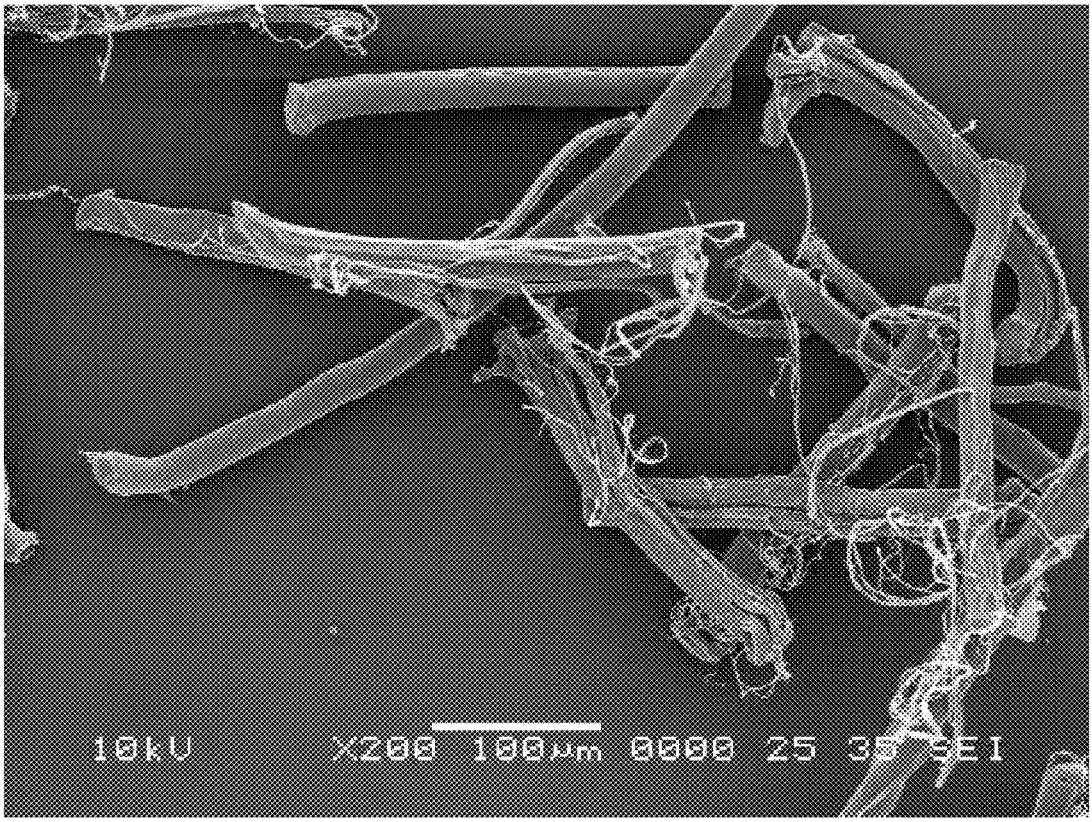
FIG. 13 is a SEM of a PTFE floe material according to the presently preferred embodiment of the present invention, as prepared in Example 3.
Figure 14:
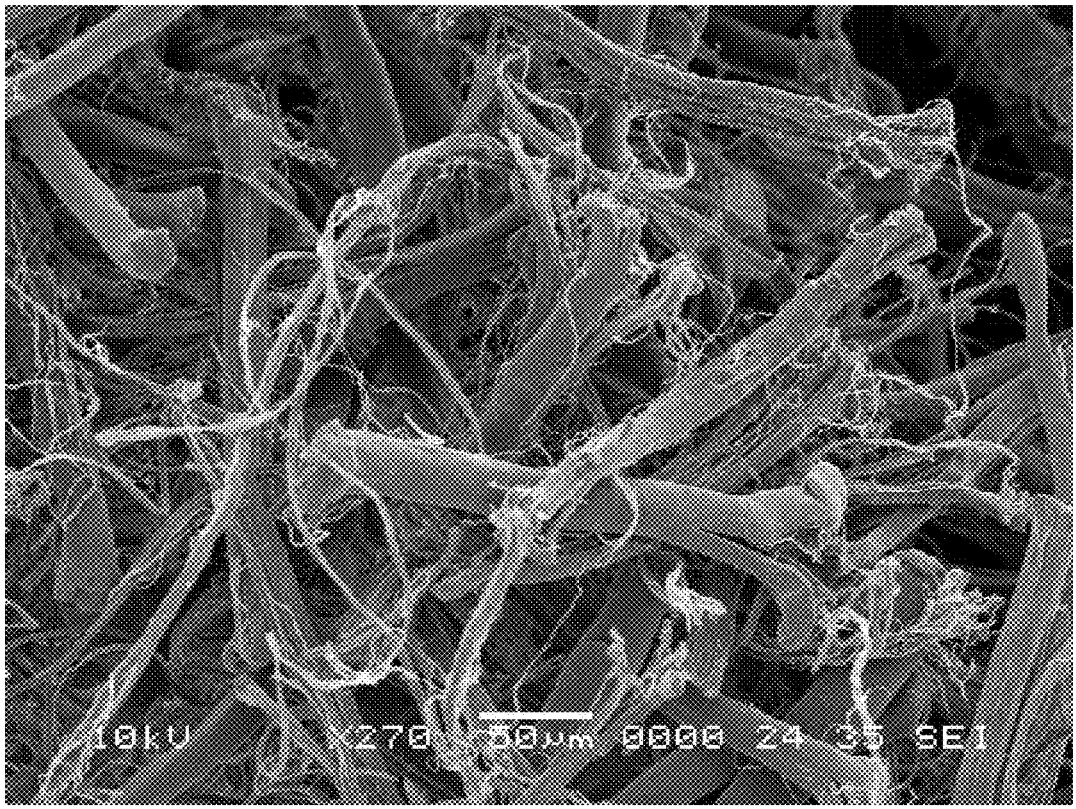
FIG. 14 is a SEM of a PTFE floe material according to the presently preferred embodiment of the present invention, as prepared in Example 3.
Figure 15:
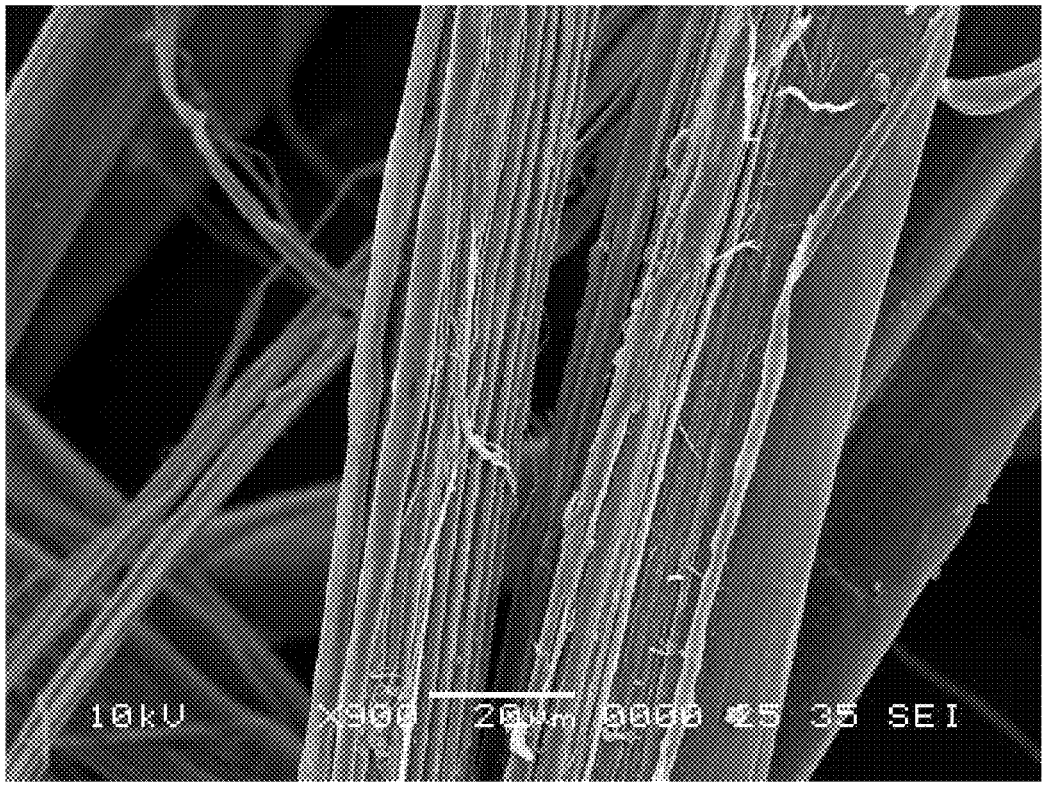
FIG. 15 is a SEM of a PTFE floe material according to the presently preferred embodiment of the present invention, as prepared in Example 4.
Figure 16:
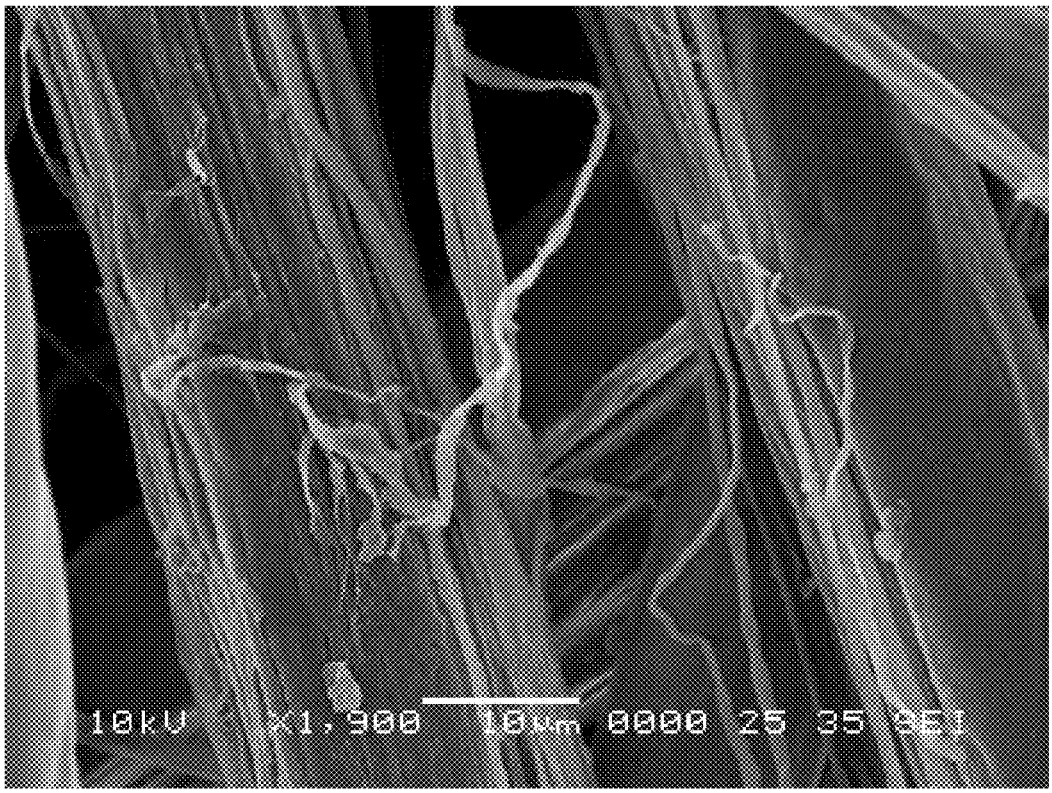
FIG. 16 is a SEM of a PTFE floe material according to the presently preferred embodiment of the present invention, as prepared in Example 4.
Figure 17:
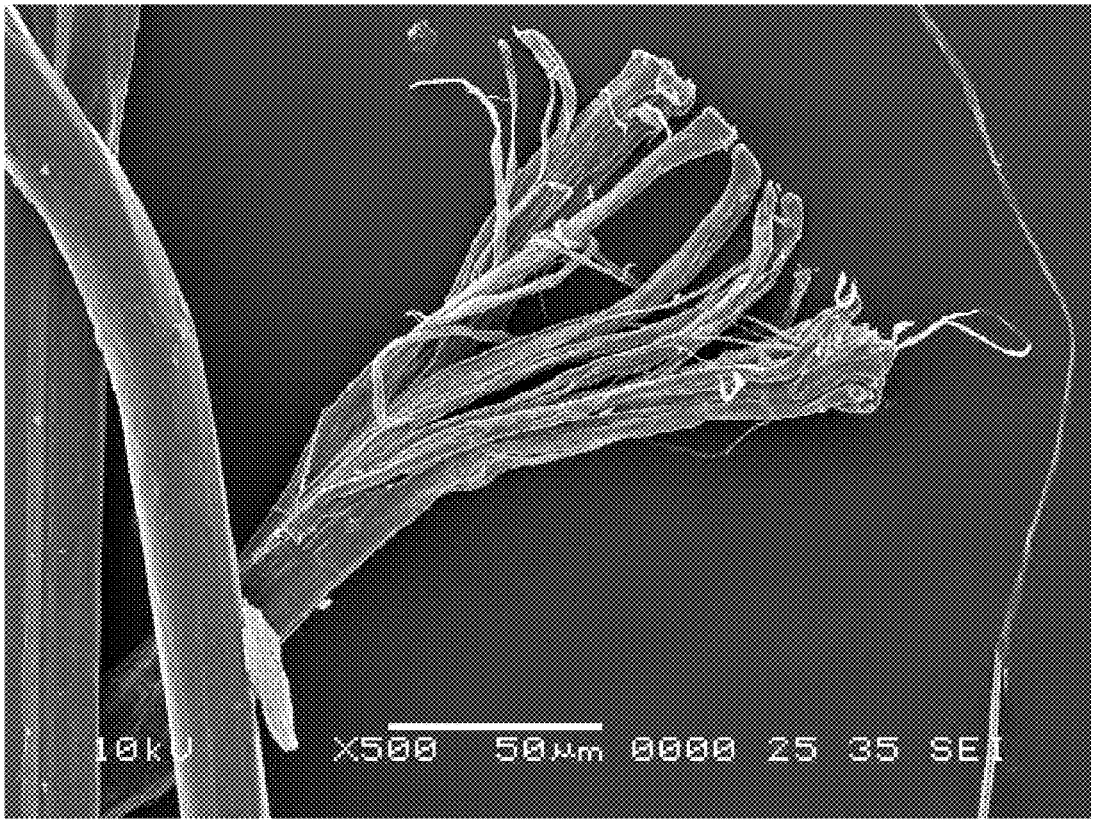
FIG. 17 is a SEM of a PTFE floe material according to the presently preferred embodiment of the present invention, as prepared in Example 4.
Figure 18:
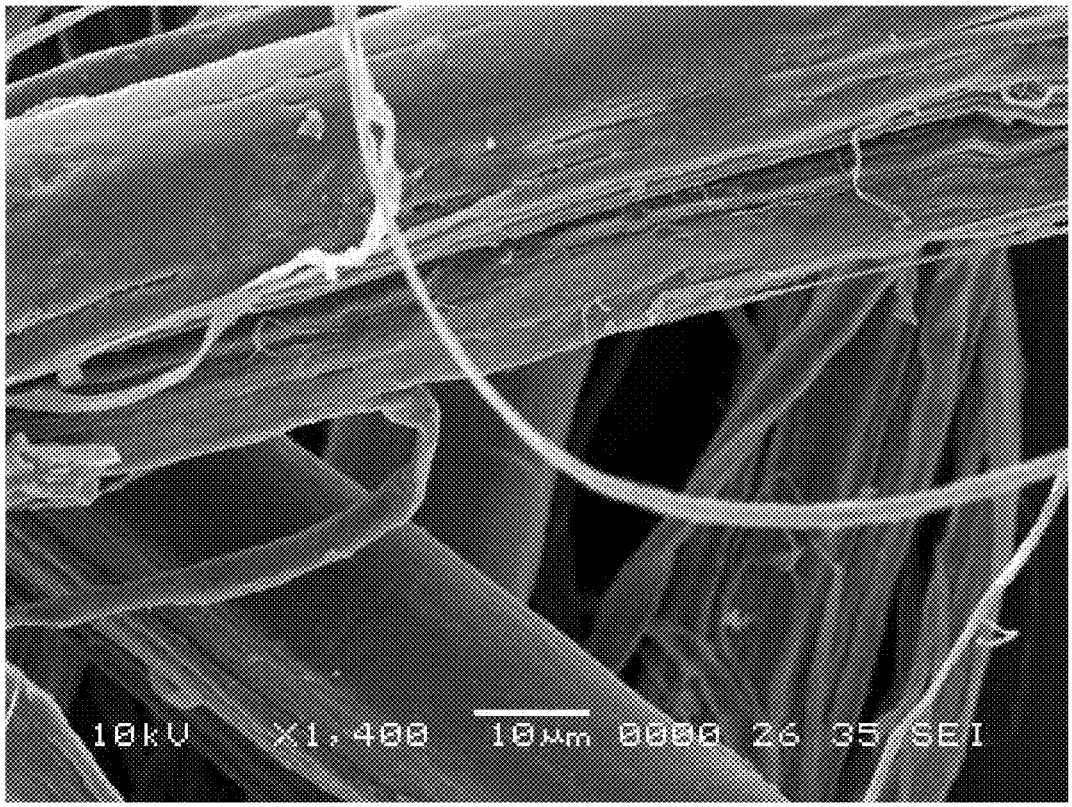
FIG. 18 is a SEM of a PTFE floe material according to the presently preferred embodiment of the present invention, as prepared in Example 4.
Figure 19:
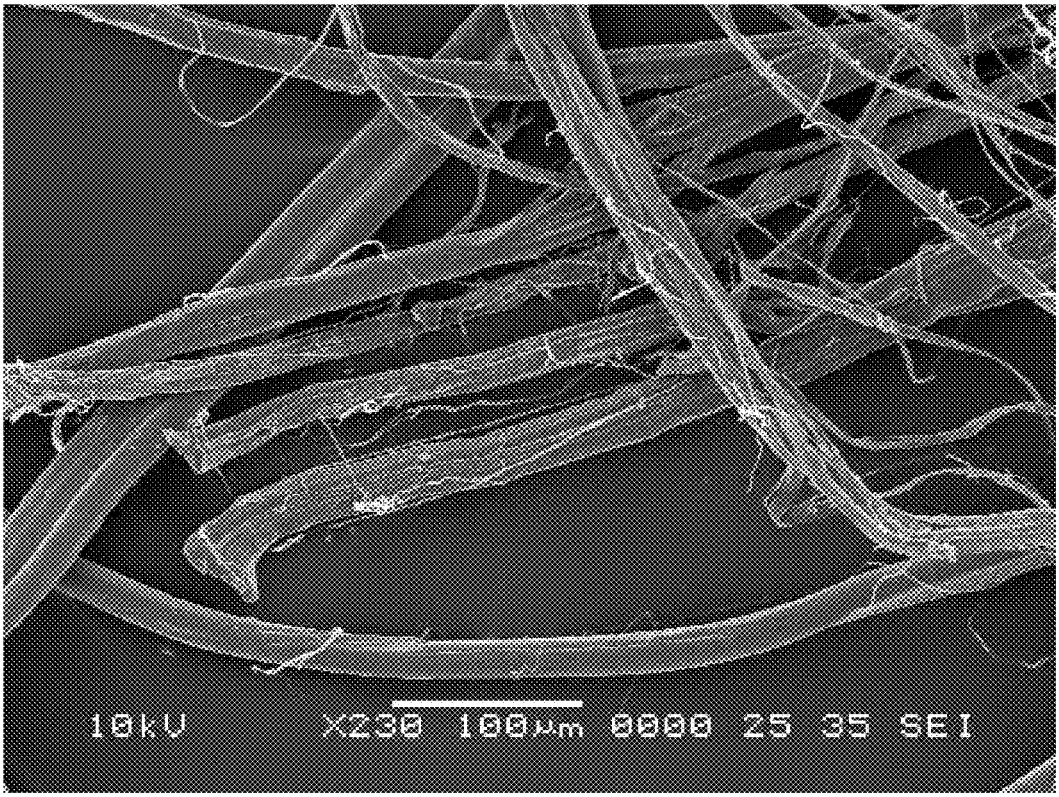
FIG. 19 is a SEM of a PTFE floe material according to the presently preferred embodiment of the present invention, as prepared in Example 4.
Figure 20:
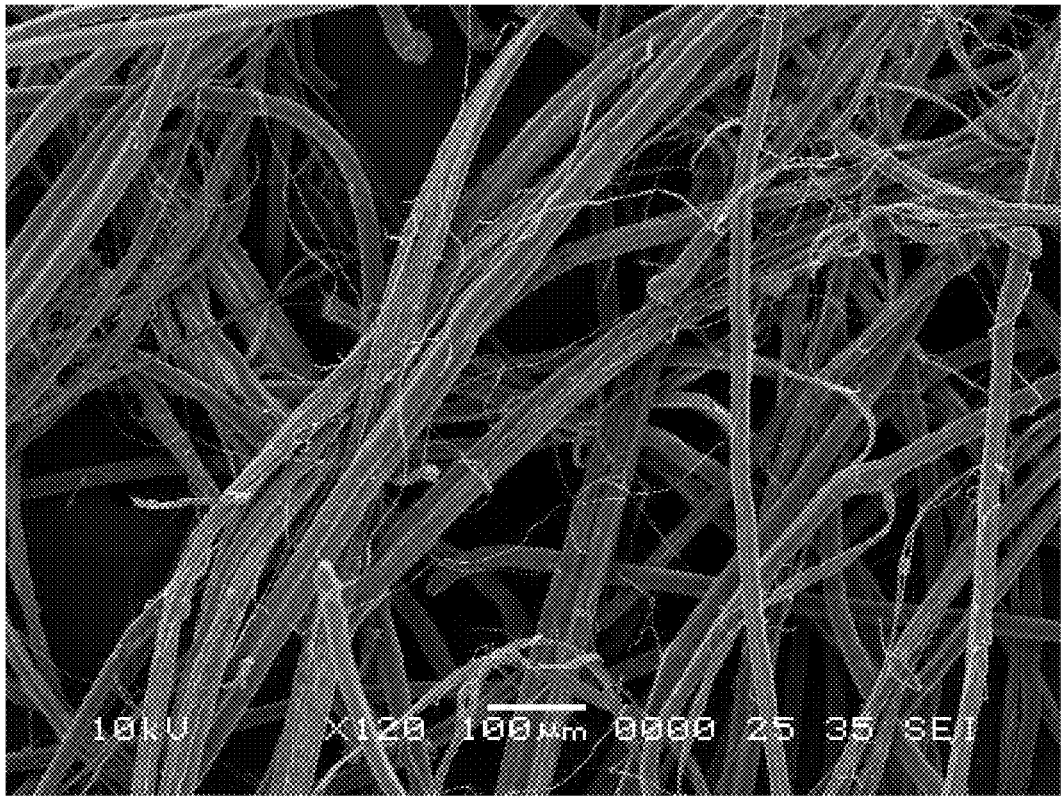
FIG. 20 is a SEM of a PTFE floe material according to the presently preferred embodiment of the present invention, as prepared in Example 4.

FIGS. 10 through 13 depict various splits through the ends of the PTFE fibers. A typical frayed fiber end is shown in FIG. 10, the fiber being frayed at both ends. The frayed portions are exhibited as individual strands having free ends and ends attached to the fiber. The fiber in FIG. 10 also appears to have had an entire side of the fiber split off from the fiber thus exposing an interior surface of the fiber that extends the length of the fiber. This occurrence is also depicted in FIGS. 6 and 7. FIG. 11 provides an example of a split that does not result in a strand having a free end but rather appears as a crack that extends through the end of the fiber.

The splits ranged in lengths from less than 1 micron to the entire length of the fibers. In those instances where substantial fraying was observed, the fiber ends included splits in the range of 50 to 75 microns.

The wettability of the jet milled, 200 to 250 microns PTFE fiber floc was tested. In a first test, 50 grams of the processed floc and 200 ml of deionized water were placed into a Waring blender and mixed for 30 seconds. Thereafter, the mixture was observed. The mixture appeared as a homogenous, aqueous dispersion of the fluoropolymer floc. No floc was observed settling at the bottom of the container, and none of the floc was observed floating on top of the mixture. The mixture maintained a homogenous state for several days even as the amount of water in the container decreased by evaporation. Eventually, enough water evaporated from the container that the wetted fluoropolymer floc took on the consistency of dough.

In a second test, the wettability of the jet milled PTFE fiber floc was determined by placing 50 grams of the processed floc and 200 ml of deionized water into a Waring blender, mixing the water and fibers for 30 seconds and immediately thereafter siphoning a portion of the mixture into a syringe. As in the first test, the mixture appeared as a homogenous, aqueous dispersion of fluoropolymer floc. No floc was observed settling at the bottom of the syringe, and none of the floc was observed floating on top of the mixture. The homogenous slurry flowed easily into and out of syringe on multiple occasions exhibiting excellent flow characteristics The tests results evidence that the jet milled, 200 to 250 microns PTFE fiber floc was hydrophilic.

Example 4

In Example 4, a portion of the 6350 microns virgin PTFE fiber floc was processed by cryogenic grinding and examined. As shown in FIGS. 15 through 20, cryogenic milling of the fluoropolymer fiber floc modified the physical appearance of the fluoropolymer fibers much like jet milling. Thus, the cryogenic milled fibers included split fiber ends, slits along the bodies of the fibers, formation of outwardly extending, fibril-like members and exposure of interior surfaces of the fibers. No substantial differences in the surface morphology of the fibers milled by the cryogenic grinding process and the jet milling processing were observed.

The wettability of the cryogenic milled, 6350 microns PTFE fiber floc was tested. Fifty grams of the processed floc and 200 ml of deionized water were placed into a Waring blender and mixed for 30 seconds. Thereafter, the mixture was observed. The mixture appeared as a homogenous, aqueous dispersion of the fluoropolymer floc. No floc was observed settling at the bottom of the container, and none of the floc was observed floating on top of the mixture. For reasons unknown, the cryogenic milled floc dispersed throughout the aqueous medium and provided the mixture with a sponge-like consistency.

The tests results evidence that the cryogenic milled, 6350 microns PTFE fiber floc was hydrophilic.

As will be apparent to one skilled in the art, various modifications can be made within the scope of the aforesaid description. Such modifications being within the ability of one skilled in the art form a part of the present invention and are embraced by the claims below.

It is claimed:

1. A method for increasing the hydrophilicity of fluoropolymer fibers comprising mechanically modifying the fluoropolymer fibers wherein the mechanically modifying includes forming a split in an end of at least one of the fluoropolymer fibers, the split having a length that is equal to between about 10% and 90% of a length of the at least one fluoropolymer fiber.

2. The method according to claim 1 wherein the the split has a length that is equal to between about 20% and about 50% of a length of the at least one fluoropolymer fiber.

3. The method according to claim 2 wherein the mechanically modifying is carried out by a jet mill.

4. The method according to claim 1 wherein the mechanically modifying does not substantially shorten a total length of a majority of the fluoropolymer fibers.

5. The method according to claim 1 wherein the mechanically modifying is carried out by colliding the fluoropolymer fibers together.

6. The method according to claim 1 wherein the mechanically modifying is carried out by a jet mill.

7. The method according to claim 1 wherein the mechanically modifying includes tearing the fluoropolymer fibers.

8. The method according to claim 7 wherein tearing the fluoropolymer fibers includes partially removing exterior surface portions of the fluoropolymer fibers.

9. The method according to claim 8 wherein the exterior surface portions remain coupled at one end thereof to the fluoropolymer fibers from which they are partially removed.

10. The method according to claim 1 wherein the mechanically modifying includes imparting a rough exposed surface on a portion of the fluoropolymer fibers.

11. The method according to claim 1 wherein the mechanically modifying includes slitting the fluoropolymer fibers.

12. The method according to claim 1 wherein the fluoropolymer fibers are flock fiber, staple fibers or combinations thereof.

13. A method for increasing the hydrophilicity of fluoropolymer fibers comprising mechanically modifying the fluoropolymer fibers wherein the mechanically modifying includes forming a tear in at least one of the fluoropolymer fibers, the tear having a depth that is greater than 1.0 micron.

14. The method according to claim 13 wherein the tear has a depth that is greater than 5.0 microns.

15. The method according to claim 14 wherein the mechanically modifying is carried out by a jet mill.

16. The method according to claim 13 wherein the mechanically modifying is carried out by colliding the fluoropolymer fibers together.

17. The method according to claim 13 wherein the mechanically modifying is carried out by a jet mill.

18. The method according to claim 13 wherein the mechanically modifying includes splitting the fluoropolymer fibers into strands.

19. The method according to claim 13 wherein the mechanically modifying includes imparting a rough exposed surface on a portion of the fluoropolymer fibers.

20. The method according to claim 13 wherein the mechanically modifying includes slitting the fluoropolymer fibers.

21. The method according to claim 13 wherein tearing the fluoropolymer fibers includes partially removing exterior surface portions of the fluoropolymer fibers.

22. The method according to claim 21 wherein the exterior surface portions remain coupled at one end thereof to the fluoropolymer fibers from which they are partially removed.

23. The method according to claim 13 wherein the fluoropolymer fibers are flock fiber, staple fibers or combinations thereof.

24. The method according to claim 13 wherein the mechanically modifying does not substantially shorten a total length of a majority of the fluoropolymer fibers.

25. The method according to claim 13 wherein the mechanically modifying includes forming a split in an end of at least one of the fluoropolymer fibers, the split having a length that is equal to between 5% and 100% of a length of the at least one fluoropolymer fiber.

26. A method for increasing the hydrophilicity of fluoropolymer fibers comprising mechanically modifying the fluoropolymer fibers wherein the mechanically modifying includes forming a plurality of fibril-like members that extend outwardly from an exposed interior surface of at least one of the fluoropolymer fibers.

27. The method according to claim 26 wherein the mechanically modifying is carried out by colliding the fluoropolymer fibers together.

28. The method according to claim 26 wherein the mechanically modifying is carried out by a jet mill.

29. The method according to claim 26 wherein the mechanically modifying includes tearing the fluoropolymer fibers.

30. The method according to claim 29 wherein tearing the fluoropolymer fibers includes partially removing exterior surface portions of the fluoropolymer fibers.

31. The method according to claim 30 wherein the exterior surface portions remain coupled at one end thereof to the fluoropolymer fibers from which they are partially removed.

32. The method according to claim 26 wherein the mechanically modifying includes splitting the fluoropolymer fibers into strands.

33. The method according to claim 26 wherein the mechanically modifying includes imparting a rough exposed surface on a portion of the fluoropolymer fibers.

34. The method according to claim 26 wherein the mechanically modifying includes slitting the fluoropolymer fibers.

35. The method according to claim 26 wherein the fluoropolymer fibers are flock fiber, staple fibers or combinations thereof.

36. The method according to claim 26 wherein the mechanically modifying does not substantially shorten a total length of a majority of the fluoropolymer fibers.

37. The method according to claim 26 wherein the mechanically modifying includes forming a split in an end of at least one of the fluoropolymer fibers, the split having a length that is equal to between 5% and 100% of a length of the at least one fluoropolymer fiber.

* * * * *